US006832844B2

(12) United States Patent
Guzorek

(10) Patent No.: US 6,832,844 B2
(45) Date of Patent: Dec. 21, 2004

(54) ULTRAVIOLET LAMP ASSEMBLY

(75) Inventor: Steven E. Guzorek, Kinston, NC (US)

(73) Assignee: Field Controls, L.L.C., Kinston, NC (US)

( * ) Notice: Subject to any disclaimer, the term of this patent is extended or adjusted under 35 U.S.C. 154(b) by 22 days.

(21) Appl. No.: 10/308,324

(22) Filed: Dec. 3, 2002

(65) Prior Publication Data

US 2004/0105260 A1 Jun. 3, 2004

(51) Int. Cl.[7] ..... H01J 61/52

(52) U.S. Cl. ..... 362/263; 362/264; 313/22; 313/24; 250/504 R

(58) Field of Search ..... 313/36, 22, 24, 313/33, 17, 20, 35; 362/363, 264, 294, 373, 376; 250/504 R, 504 H, 455.11

(56) References Cited

U.S. PATENT DOCUMENTS

| | | | | | |
|---|---|---|---|---|---|
| 3,026,435 | A | * | 3/1962 | McPherson | 313/22 |
| 3,923,663 | A | * | 12/1975 | Reid | 210/251 |
| 4,049,987 | A | * | 9/1977 | Helms | 313/112 |
| 4,179,616 | A | * | 12/1979 | Coviello et al. | 422/186.3 |
| 4,751,392 | A | * | 6/1988 | Wiesmann | 250/429 |
| 6,201,355 | B1 | | 3/2001 | Morgan et al. | |
| 6,221,314 | B1 | | 4/2001 | Bigelow | |
| 6,296,775 | B1 | | 10/2001 | Moody et al. | |
| 6,337,483 | B1 | * | 1/2002 | Matschke | 250/432 R |

FOREIGN PATENT DOCUMENTS

| | | | | | |
|---|---|---|---|---|---|
| JP | 62016767 | A | * | 1/1987 | |
| JP | 07204258 | A | * | 8/1995 | A61L/9/015 |
| JP | 08182749 | A | * | 7/1996 | A61L/9/20 |
| JP | 2000070651 | A | * | 3/2000 | B01D/53/04 |

* cited by examiner

*Primary Examiner*—John Anthony Ward
*Assistant Examiner*—Hargobind S. Sawhney
(74) *Attorney, Agent, or Firm*—McDermott Will & Emery LLP

(57) ABSTRACT

There is provided an improved ultraviolet lamp assembly using an ultraviolet lamp with a vented closed end quartz tube having improved and increased ultraviolet lamp intensity output for increased germicidal and bactericidal effect for use in purification, sterilizing, sanitizing and cleaning systems. The ultraviolet lamp assembly comprises an ultraviolet lamp, a tube operative to house the ultraviolet lamp and comprising a closed end, an open end able to allow insertion of said ultraviolet lamp and having a plurality of vents that allow air into and out of an air space between the ultraviolet lamp and the surrounding tube, a tube divider operatively disposed between said UV lamp and said tube to thereby divide said air space into at least two air space compartments enabling air to circulate through said tube, and an air displacer operatively connected to at least one of said vents and able to produce air flow in said tube.

22 Claims, 9 Drawing Sheets

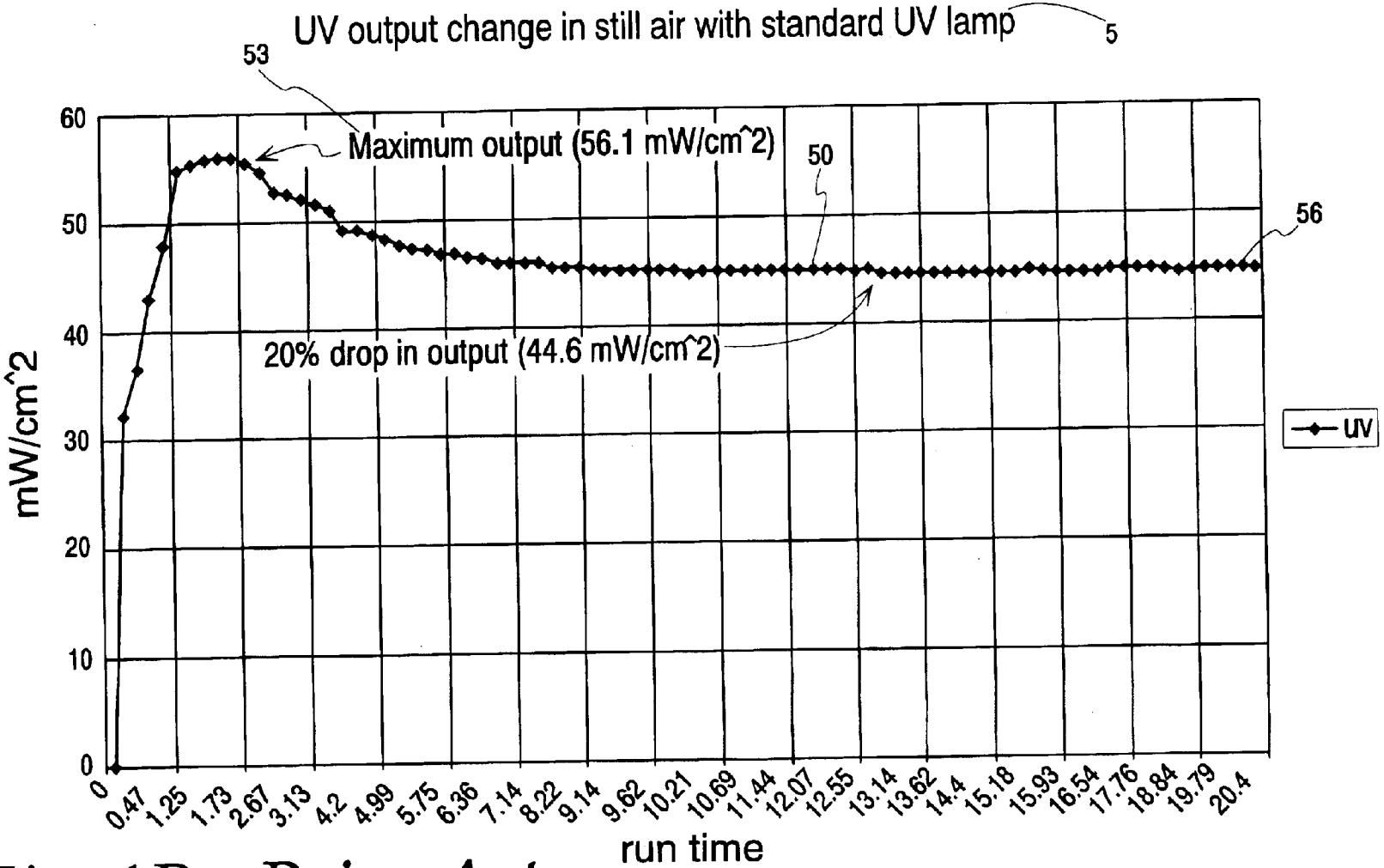
Fig. 1B - Prior Art

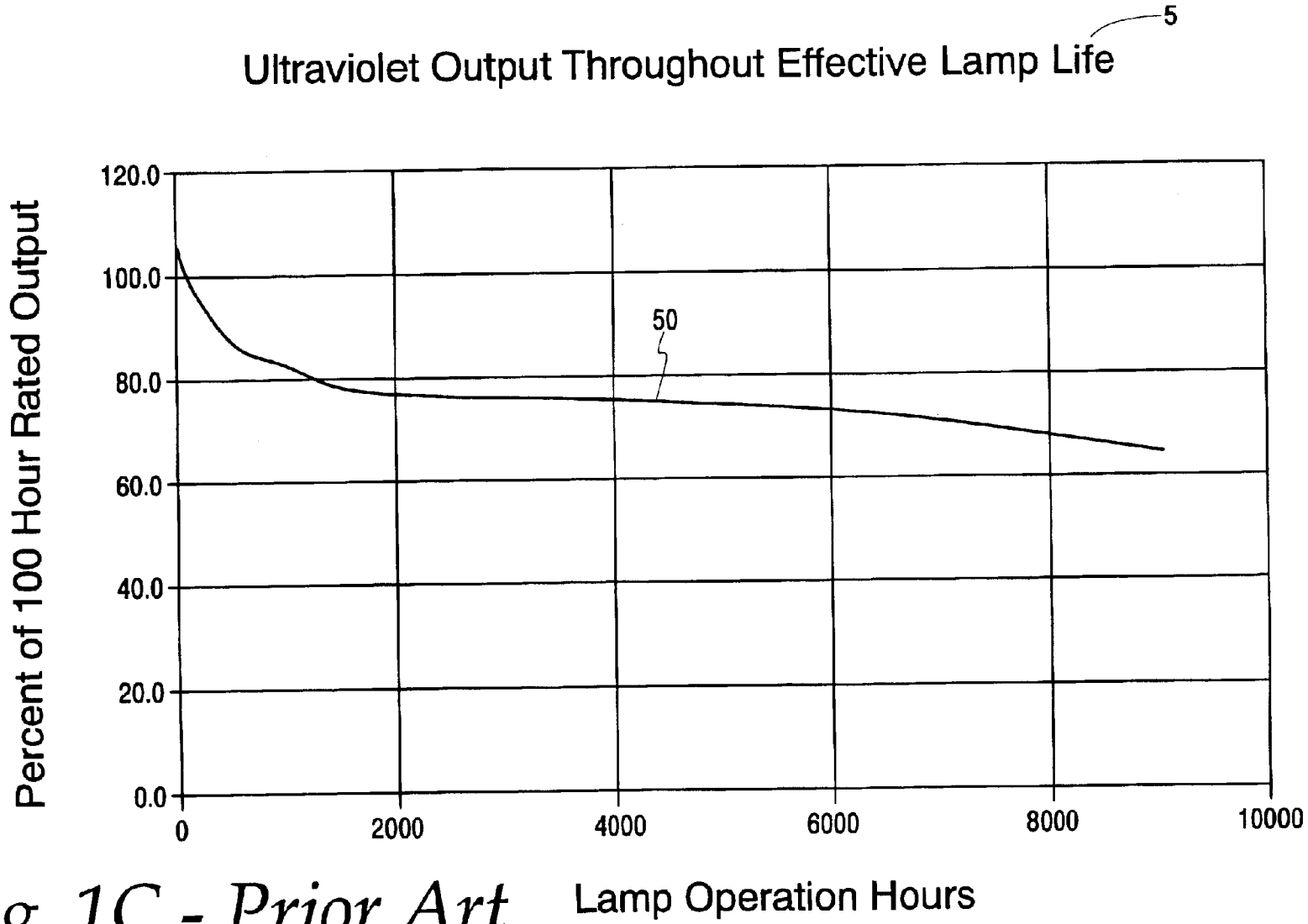
*Fig. 1C - Prior Art*

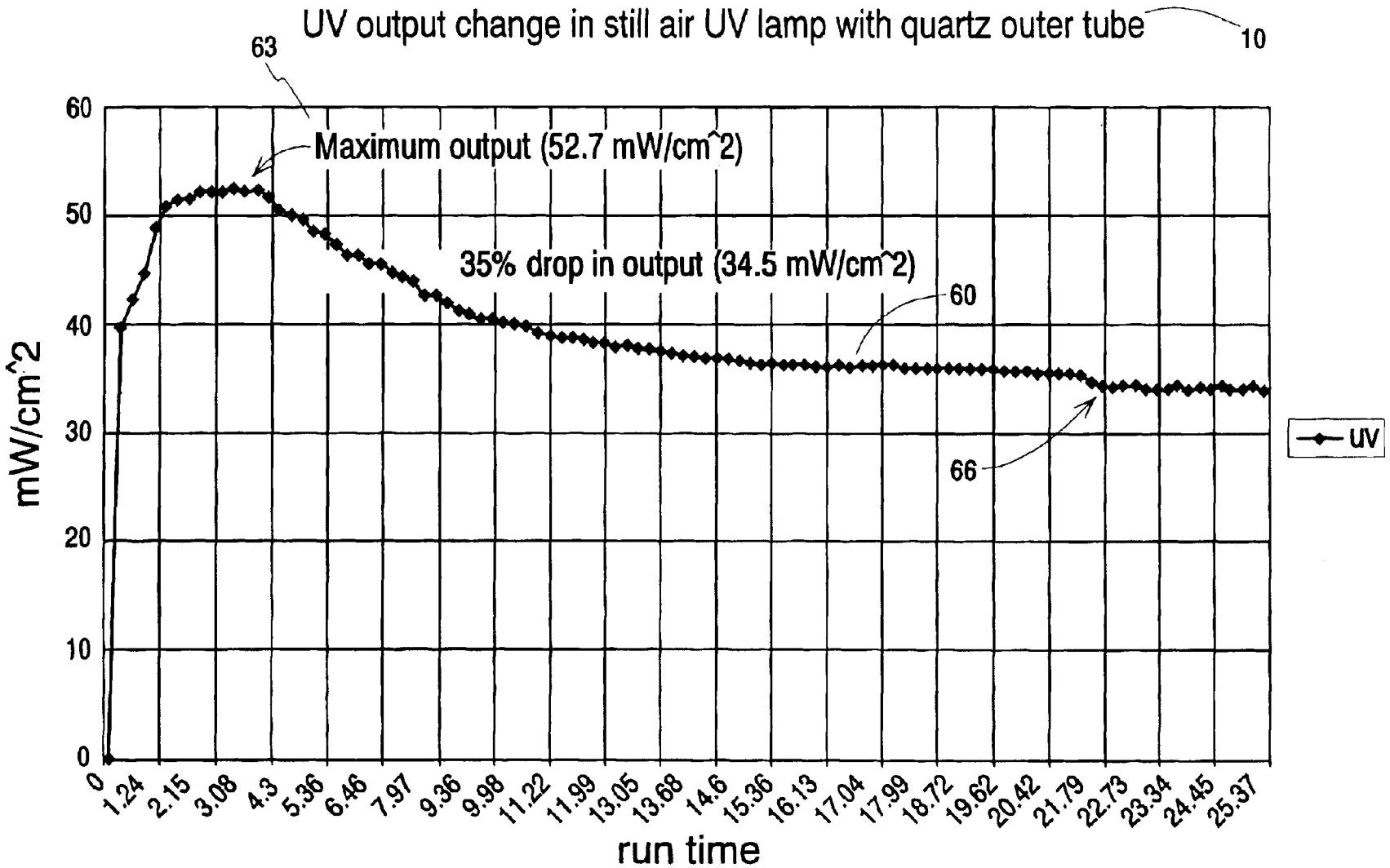
*Fig. 1D - Prior Art*

ULTRAVIOLET LAMP ASSEMBLY

FIELD OF THE INVENTION

The present invention generally relates to an ultraviolet lamp assembly for killing germs or bacteria in air ventilation systems. Specifically, the present invention relates to an ultraviolet lamp including a quartz sleeve having a vented open end which results in increased or improved germicidal and bactericidal effect in systems and apparatus using ultraviolet lamps for purification or cleaning of air.

BACKGROUND OF THE INVENTION

The use of ultraviolet ("UV") light or radiation for its purification, germicidal and bactericidal effect is well known. UV light is commonly used to control the growth of and kill impurities in septic, water and air systems. For example, UV light or UV lamps are commonly used in heating, ventilation, and air conditioning ("AC" or "HVAC") systems for purification or air cleaning purposes. UV lamps are typically installed or mounted in the air ducts of AC systems in such a manner that the UV light emitted by the lamp floods the interior of the air duct. Air flowing through that duct will be irradiated with UV radiation which will have a germicidal or bactericidal affect on the moving air thereby reducing the impurities in the air flow.

Existing air cleaning systems or devices commonly employ UV lamps similar to those shown in FIG. 1A. FIG. 1A shows a standard lamp 5 and a sealed lamp 10 with a quartz sleeve 15 built right onto the UV lamp 10. FIG. 1A also shows a typical external quartz sleeve 20 that is often used to house standard UV lamps 5. The quartz sleeve 20 can be used, for example, to physically separate the standard UV lamp 5 from a contaminated medium, i.e. the liquid or air to be cleaned, that is being irradiated with UV radiation.

Existing air cleaning devices typically employ the standard or sealed UV lamps 5 and 10 alone or in combination with a closed end outer quartz sleeve 20. A drawback of the UV lamps 5 and 10 used in existing cleaning devices or assemblies is that the UV lamps 5 and 10 typically have diminished UV radiation output intensity over time that results in reduced germicidal and bactericidal affect of the UV lamp cleaning device. For example, FIG. 1B illustrates a typical plot of a standard UV lamp output intensity 50 over time for a typical UV lamp 5 in still air. FIG. 1B indicates that the UV lamp output 50 typically reaches its maximum rated output intensity 53, at about 56.1 mWatts/cm$^2$, after the first few minutes of operation after an initial heat up period of the UV lamp 5. The UV lamp output 50 then typically decreases over time to a generally steady lamp intensity output 56 of about 44.6 mWatts/cm$^2$ as the lamp continues to operate. The steady state output 56 is about 20% less that the maximum output 53 obtained during the first few minutes of UV lamp 5 operation. The drop in UV lamp output intensity 50 is typically due to the inconsistent and variable temperature around the UV lamp 5 that does not allow proper and uniform UV lamp 5 cooling. The diminished UV lamp output 50 shown in FIG. 1B is even more pronounced when air or water is circulated around the lamp which causes a higher rate of cooling as is well know to those of skill in the art.

Moreover, inconsistent and variable temperatures present around the standard UV lamp 5 result in a cooling affect that does not allow proper and uniform UV lamp 5 cooling. In the long term, this cooling effect can adversely affect the UV lamp's 5 germicidal or bactericidal effect by causing the inside of the lamp to blacken or darken which in turn causes or results in a reduced UV lamp output intensity level 50. FIG. 1C graphically illustrates the loss of UV lamp output intensity 50 throughout the effective life of the UV lamp 5 as a result of the cooling effect. FIG. 1C indicates that throughout the effective life of the UV lamp 5, the percent of 100 hour rated output of the UV lamp 5 experiences a fairly steep decrease from about 100% when first operated to about 80% at about 1300–1325 hours of UV lamp 5 operation, and to about 65% at about 9000 hours of UV lamp 5 operation. The UV lamp output intensity 50 loss experienced throughout the life of the UV lamp 5 is another drawback of existing standard UV lamps 5.

In another typical UV lamp configuration, the UV lamp 10 is mounted inside a quartz tube as an attempt to counter act know lamp-cooling issues or problems. However, this configuration, when operated in still air, results in a larger drop in UV lamp intensity output 60 that that shown in FIG. 1B. FIG. 1D illustrates a typical plot of UV lamp output intensity 60 over time for a typical UV lamp with a quartz outer tube 10 in still air. FIG. 1D shows that the UV lamp output 60 typically reaches its maximum rated output intensity 63, at about 52.7 mWatts/cm$^2$, after a few minutes of operation after the initial heat-up or warm-up period of the UV lamp with a quartz outer tube 10. Again, the UV lamp output 60 will typically decrease to a generally steady lamp intensity output 66 of about 34.5 mWatts/cm$^2$ as the lamp continues to operate. In this configuration, the steady state output 66 is about 35% less that the maximum output 63 obtained during the first few minutes of UV lamp 10 operation. Thus, the quartz outer tube results in a greater loss of UV lamp output intensity 60.

There is thus a need for an improved ultraviolet UV lamp assembly having increased and/or improved UV radiation intensity output for improved germicidal and bactericidal effect in purification, sterilization, cleaning of airflow systems.

SUMMARY OF THE INVENTION

The present invention provides an improved ultraviolet lamp assembly using an ultraviolet (UV) lamp with a vented closed end quartz sleeve or tube having improved and increased UV lamp intensity output for increased germicidal and bactericidal effect. The UV lamp assembly of the present invention can be used in systems and applications with the goal to purify, sterilize, clean and sanitize a medium, object or apparatus.

The ultraviolet lamp assembly comprises a UV lamp housed in a vented closed end quartz sleeve or tube. The quartz sleeve further comprises a closed end and an open end through which the UV lamp is inserted into and secured to the tube. The open end of the quartz sleeve comprises a plurality of inlet and outlet venting slots or ports that allow the air between the UV lamp and the sleeve wall to enter and exit the quartz sleeve or tube. The UV lamp assembly also comprises a sleeve divider operatively disposed between the UV lamp and the sleeve wall that divides the interior of the sleeve into two interior compartments that allow air to circulate through the quartz sleeve. The ultraviolet lamp assembly further comprises an air displacer or fan operatively connected to at least one of the venting slots for production of air flow into and out of the quartz tube.

It is an object of the present invention to provide an ultraviolet lamp assembly that can be used in an AC or HVAC systems, and air ducts for purification and cleaning of air flowing in the AC or HVAC system and air ducts.

It is an object of the present invention to provide a UV lamp assembly with a vented closed end quartz sleeve to provide improved and constant UV radiation intensity output.

It is an object of the present invention to provide a divider in the vented closed end quartz sleeve resulting at least two compartments in the sleeve that allow air to circulate through the sleeve resulting in normalized or constant UV lamp temperature.

It is an object of the present invention to increase UV lamp life by producing more consistent and stable UV lamp temperature.

It is an object of the present invention to provide a UV lamp assembly with a vented closed end quartz sleeve and a sleeve fan that provides air flow in the sleeve in the range of about 0.5 cfm to 10 cfm when an associated sleeve fan is operating.

It is an object of the present invention to provide a UV lamp assembly with a vented closed end quartz sleeve where the UV radiation intensity output is substantially uniform and constant about 100–110 mWatts/cm$^2$ when an associated sleeve fan is operating.

It is an object of the present invention to provide a UV lamp assembly having an effective germicidal and bactericidal affect in a wavelength bandwidth of about 240 nm to 360 nm.

It is an object of the present invention to provide an ultraviolet lamp assembly that can be used to purify air in an airflow system such as an air conditioning system in a home, hotel or building.

It is an object of the present invention to provide an ultraviolet lamp assembly that can be used to purify liquids, such as water, in a liquid purification system, such as a water treatment plant.

It is an object of the present invention to provide an ultraviolet lamp assembly that can be used to purify or sterilized objects or apparatus such as medical instruments and equipment.

The following drawings and description set forth additional advantages and benefits of the invention. More advantages and benefits will be obvious from the description and may be learned by practice of the invention.

BRIEF DESCRIPTION OF THE DRAWINGS

The present invention may be better understood when read in connection with the accompanying drawings, of which:

FIG. 1B illustrates a typical plot of UV lamp output intensity over time for a typical UV lamp in still air;

FIG. 1C illustrates typical loss of UV lamp output intensity throughout the effective life of a typical UV lamp due to cooling effect;

FIG. 1D illustrates a typical plot of UV lamp output intensity over time for a typical UV lamp with a quartz outer tube in still air;

FIG. 3 illustrates ultraviolet output intensity and lamp temperature over a test period for the lamp assembly of FIG. 2 where a lamp fan is ON.

DETAILED DESCRIPTION

Figure 2A:
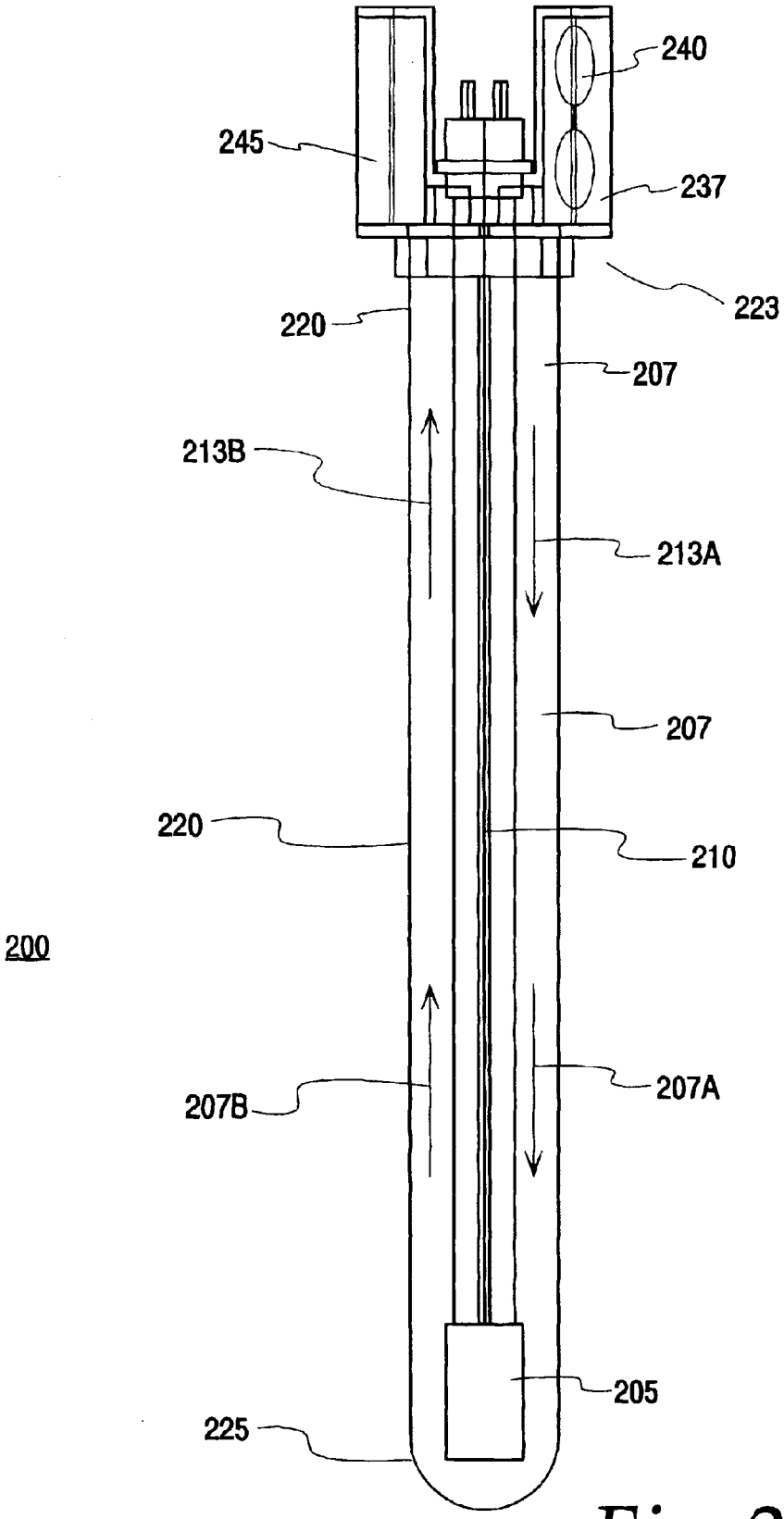
FIG. 2A illustrates an embodiment of a novel ultraviolet lamp assembly in accordance with the present invention.

FIG. 2A shows an embodiment of the novel ultraviolet lamp assembly 200 according to the present invention that can be used in a cleaning, purification or sanitizing system. The UV lamp assembly 200 preferably comprises a UV lamp 205, a closed end quartz sleeve 220, a tube divider 210, an air displacer or fan 240 and a plurality of air vents or ports 237 and 245. The ultraviolet (UV) lamp (205) preferably has a bandwidth of about 240 nm to 360 nm for germicidal and bactericidal effect. Other bandwidths or a particular wavelength may be used for specific purification applications. The UV lamp 205 may be an ozone free UV lamp operatively housed in the elongated sleeve or tube 220. However, other types of lamps may be used and the assembly may have one or more UV lamps 205.

The sleeve or tube 220 is preferably comprised of a quartz material, however other suitable UV transparent materials may used to make up the sleeve 220. The sleeve 220 is preferably an elongated hollow tube with a proximal open end 223 having a plurality of venting orifices, air vents, slots or ports 237 and 245, and a distal closed end 225. The open end 223 preferably comprises a plurality of inlet and outlet vents or ports 237 and 245 that enable or allow air to enter and exit the quartz sleeve 220. The sleeve 220 preferably houses the UV lamp 205 but could have other physical configurations to compliment and house a UV lamp 205 having other shapes and sizes.

The UV lamp 205 is preferably positioned and secured on the sleeve 220 at the proximal open end 223 of the sleeve 220. When the UV lamp 205 is operatively positioned in the sleeve 220 there is formed or results an air space 207 between the UV lamp's 205 outer or exterior surface and the interior surface or wall of the sleeve 220. Further, there is preferably a tube or sleeve divider 210 operatively positioned or disposed in the sleeve 220 interior or air space 207 between the UV lamp 205 and sleeve 220. The tube divider 210 preferably separates the air space 207 into two air space compartments 207A and 207B. Those of skill in the art will readily recognize that additional dividers 210 could be used resulting in a different number of air space compartments 207. The tube divider 210 and the resulting two air space compartments 207A and 207B in conjunction with the venting ports 237 and 245 comprise or form an airflow path for the circulation of air or air flow through the interior of the quartz sleeve 220. This will allow or enable air, or other medium, e.g., a gas or liquid, to preferably be displaced and to circulate down 213A on one side of the tube 220 and back up 213B the other side of the tube 220. Alternatively, the airflow could be reversed if desired for or dictated by a certain application or system that uses the UV lamp assembly 200.

The preferred embodiment shown in FIG. 2A comprises an air displacer or fan 240 that is used as the driver to force or move air into and/or out of the interior or air space 207 between the UV lamp 205 and sleeve 220. The air displacer or fan 240 is preferably cooperatively and operatively connected to at least one of the sleeve vents or ports 237 and 245 to provide for air flow in the UV lamp 205 and sleeve 220 combination. In this embodiment, the air displacer or fan 240 is positioned in a port designated as an intake port 237 such that in operation, the fan 240 will force air, or another selected medium, into the space 207 between the UV lamp 205 and the sleeve 220. The second port 245 is open such that it provides an exit way for the air being forced in by the fan 240. In this manner air will traverse or circulate into and out of the space 207 between the UV lamp 205 and the sleeve 220. Those of skill in the art will readily recognize that the fan could be placed in the other vent port 245 instead, or that two cooperative fans 240 could be used to move or circulate air, gas or another medium into and out of the space 207 between the UV lamp 205 and the sleeve 220.

Thus, as shown in FIG. 2A, the fan 240 will preferably provide air flow into the space 207 between the UV lamp 205 and the sleeve 220 and the air will exit at the second vent port 245, which in this embodiment does not have a fan 240. In a preferred embodiment, the fan or air mover 240 can provide a flow rate in the range of 0.5 to 10 cubic feet per min (cfm) to preferably maintain a consistent temperature outside or around the UV lamp of between 85° F. to 95° F. This will allow the UV lamp intensity output to be maintained near its maximum output. Those of skill in the art will readily recognize that the flow rate and temperature will vary for different length UV lamps 205 and lamps with varying power ratings depending on a particular application or usage of the UV lamp assembly 200.

As briefly discussed previously, when the fan 240 is in operation, air is introduced into the space 207 between the UV lamp 205 and the sleeve 220 via the vent intake 237 into the first 207A of two compartments created by the sleeve divider 210. The air then travels from the first 207A compartment to the second 207B compartment. From the second compartment 207B, the air will then be forced out of the quartz sleeve 220 through the vent outlet 245. The forced airflow 213A and 213B provided by the fan 240 allows air to circulate through the quartz sleeve which will result in substantially normalized or constant UV lamp temperature which in turn results in a constant UV intensity output that is closer to the maximum UV output for the UV lamp 205. The improved UV intensity output will allow the UV lamp assembly 200 to provide better and increased germicidal and bactericidal effect. This will enable a system that uses the UV lamp assembly to better purify, sterilize, clean, or sanitize a medium, such as air or liquid, or an object, such as a medical instrument or apparatus. In the case of an air conditioning system (AC), for example as might be used in a home, hotel or commercial or industrial application, use of the UV assembly 200 will result in cleaner air moving or flowing in the air ducts of the AC system.

Figure 2C:
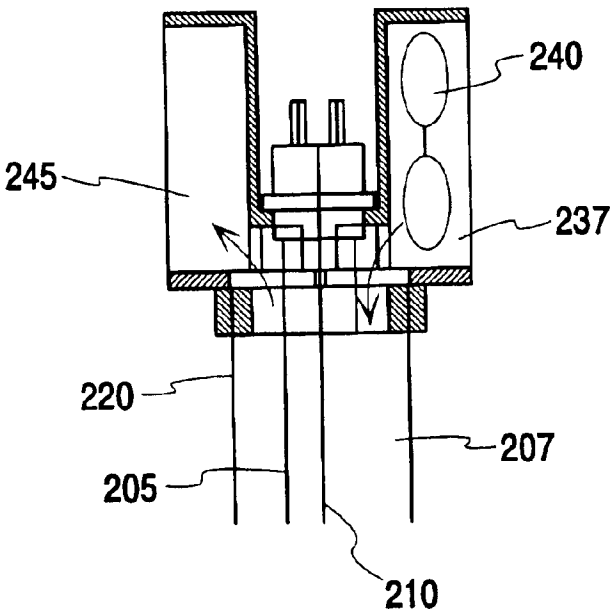
FIG. 2C illustrates in more detail a section of the ultraviolet lamp assembly of FIG. 2A showing an embodiment of vent ports in accordance with the present invention.
Figure 2B:
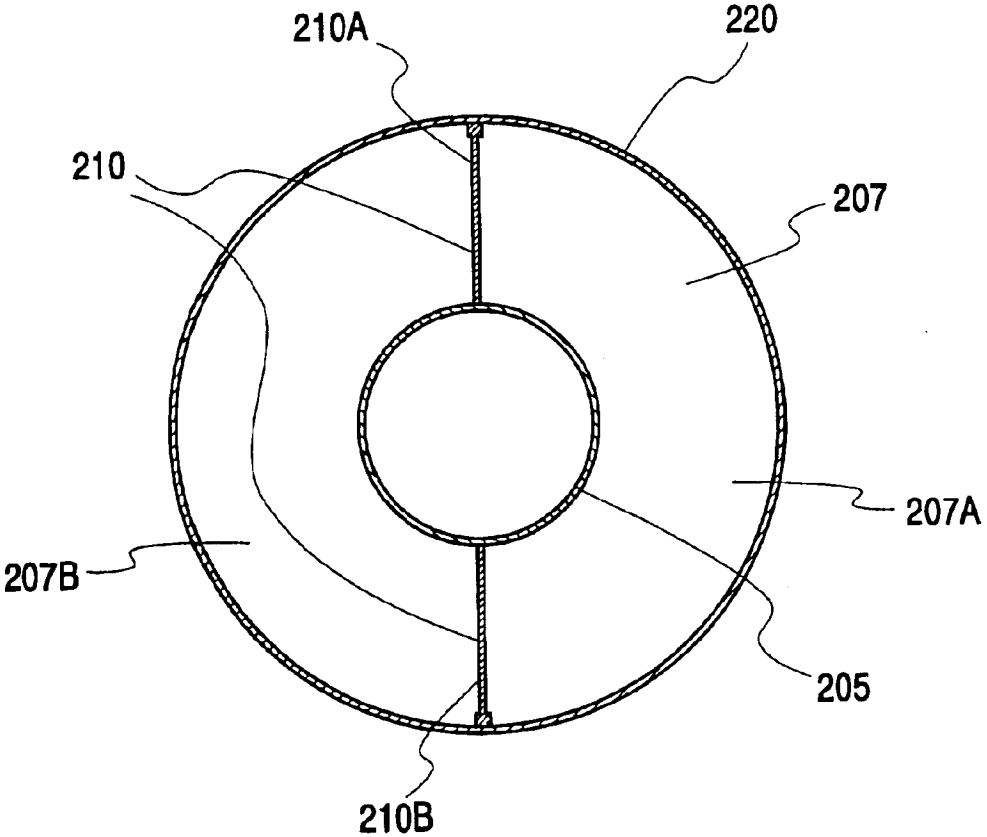
FIG. 2B illustrates a cross-section of the ultraviolet lamp assembly of FIG. 2A showing in more detail an embodiment of a tube divider in accordance with the present invention.

FIG. 2B shows a cross-section of the ultraviolet lamp assembly of FIG. 2A showing in more detail an embodiment of a tube divider in accordance with the present invention. As shown in FIG. 2B, the tube or sleeve divider 210 is preferably comprised of a first 210A and a second 210B tube divider which are operatively positioned or disposed in the interior space 207 between the UV lamp 205 and sleeve 220. The tube dividers 210A and 210B preferably separate the air space 207 into a first and second interior space compartment 207A and 207B. Those of skill in the art will readily recognize that additional dividers 210, 210A and 210B could be used resulting in a different number of interior space compartments 207, 207A and 207B. The number of tube dividers 210 can vary depending on the specific application or use of the UV lamp assembly 200. The tube divider 210 and the resulting two air space compartments 207A and 207B provide an airflow path for the circulation of air or air flow through the interior of the sleeve 220.

FIG. 2C shows the open end section 223 of the ultraviolet lamp assembly of FIG. 2A and shows the vent ports 237 and 235 and the fan 240 used force or move air into the interior space 207 between the UV lamp 205 and sleeve 220. In this embodiment, the air displacer or fan 240 is positioned in the intake or inflow port designated as an intake port 237 such that in operation, the fan 240 will force air, or another selected medium, into the space 207 between the UV lamp 205 and the sleeve 220. The second port 245 is open or unobstructed, and is shown without a fan 240, such that it provides an exit path for the air being force in by the fan 240 at the intake port 237. In this manner air will traverse or circulate into and out of the space 207 between the UV lamp 205 and the sleeve 220. Those of skill in the art will readily recognize that the fan 240 could be placed in the other vent port 245 instead to move air into or out of the space 207 between the UV lamp 205 and the sleeve 220, or that two cooperative fans 240 could be used to move or circulate air, gas or another medium into and out of the space 207 between the UV lamp 205 and the sleeve 220.

Figure 1A:
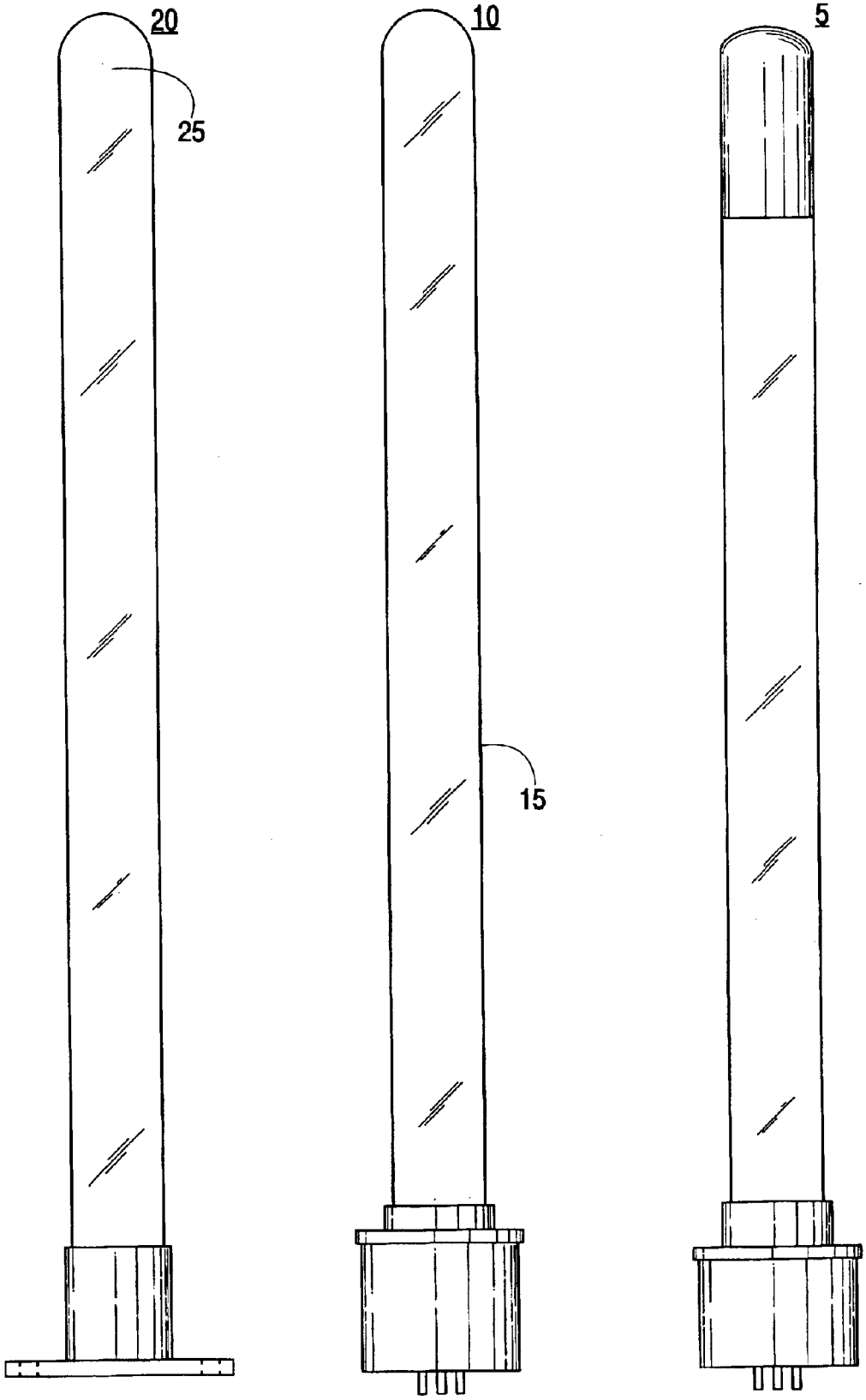
FIG. 1A illustrates existing ultraviolet lamps and lamp housings used in existing ultraviolet lamp assemblies.
Figure 2D:
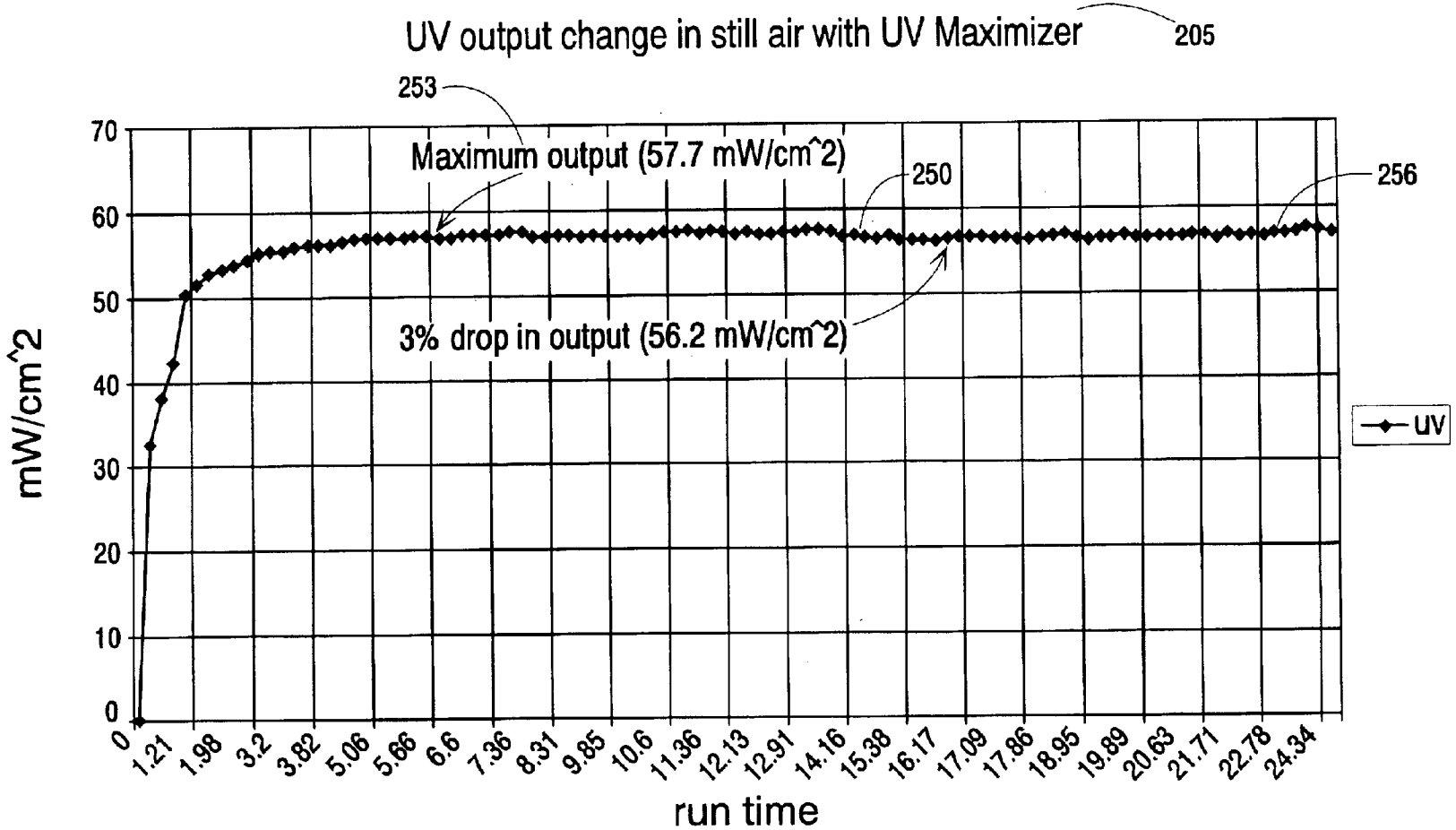
FIG. 2D illustrates a plot of UV lamp output intensity over time for the UV lamp of FIG. 2A in still air.

FIG. 2D shows the resultant plot of UV lamp output intensity over time for the UV lamp assembly 200 of FIG. 2A that uses the UV lamp 205 with the tube divider 210 in still air. FIG. 2D shows that the UV lamp output 250 typically reaches its maximum rated output intensity 253, at about 57.7 mWatts/cm2, after the first few minutes of operation after an initial heat up period of the UV lamp 205. FIG. 2D shows the improvement in UV lamp intensity output 250 of the UV lamp assembly 200 compared to prior art UV lamps 5 and 10 that do not have a divider 210 or air mover 240 (see FIGS. 1B and 1D). Unlike prior art UV lamps 5 and 10, the UV lamp output 250 of the present invention does not experience a significant decrease in UV lamp output 250 over time as the UV lamp 205 continues to operate. The UV lamp assembly 200 with the divider 210 and air mover 240 substantially maintains the UV intensity output 250 of the UV lamp 205 at or above the rated output of the UV lamp 205. In another embodiment, the UV lamp assembly 200 maintains the UV intensity output 250 of the UV lamp 205 within 3% of the rated output of the UV lamp 205 as shown in FIG. 2D. The steady state output 256 is about 56.2 mWatts/cm2, only about a 3% drop from the maximum UV lamp intensity output 253 obtained during the first few minutes of UV lamp 205 operation.

Comparing the UV lamp intensity output of FIG. 2D to those of FIGS. 1B and 1D, the UV lamp assembly 200 apparatus and method of the present invention increases the maximum UV lamp output 253 by 2.8% verses the standard UV lamp 5, and by 9.4% verses the sealed quartz lamp 10. The biggest change experienced with the novel UV lamp assembly 200 is clearly seen in the steady state operation of the UV lamp 205. The UV lamp assembly 200 apparatus and method increased the UV lamp output 250 and 256 by 26% verses the standard lamp 5 and by 62.8% verses the sealed quartz lamp 10. Further, the novel UV lamp assembly 200 apparatus and method of the present invention results in consistent and more stable UV lamp 205 temperature which improves or increases the life of the UV lamp 205.

Figure 3:
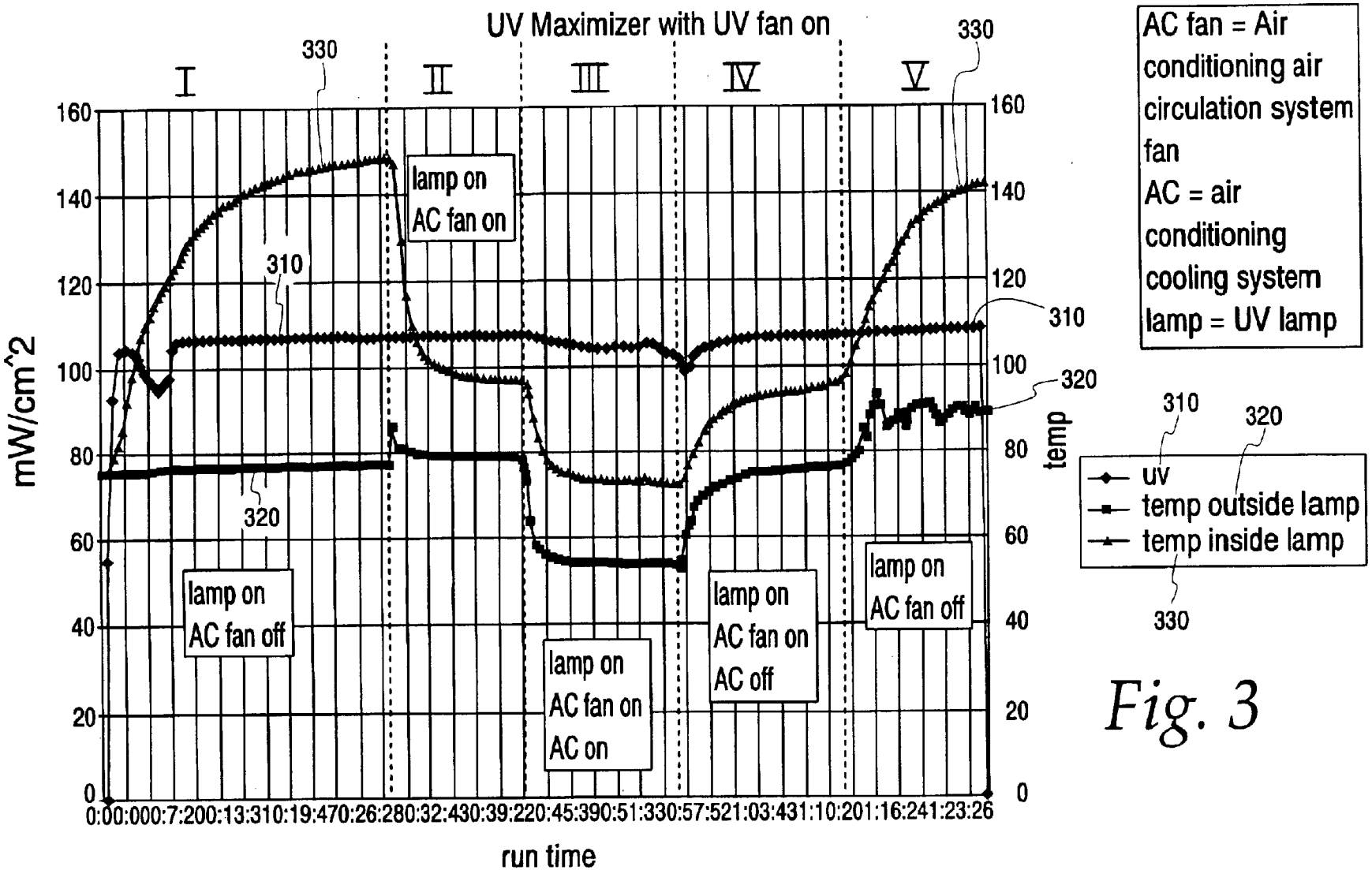
Figure 4:
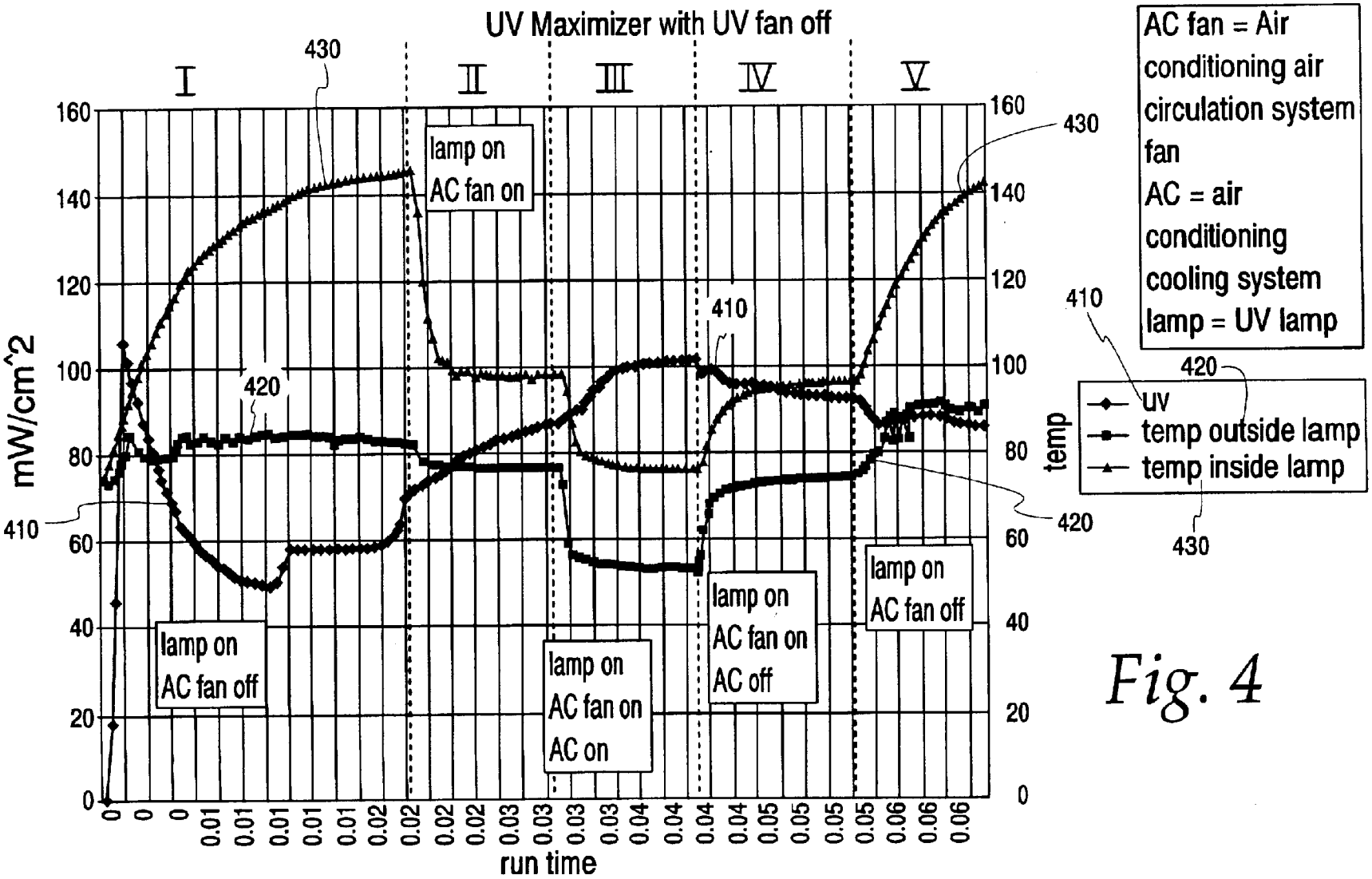
FIG. 4 illustrates ultraviolet output intensity and lamp temperature over a similar test period for the lamp assembly of FIG. 2 where a lamp fan is OFF.

FIGS. 3 and 4 illustrate ultraviolet output intensity and UV lamp temperatures over a test period for an embodiment of the UV lamp assembly 200 used in an air conditioning (AC) system where the lamp venting fan 240 is ON (FIG. 3) and where the lamp fan 240 is OFF (FIG. 4). FIGS. 3 and 4 depict various operating conditions I, II, III, IV and V of both the AC system and the UV lamp assembly 200.

In a first operating condition I, the UV lamp 205 with the closed end vented quartz sleeve or tube 220 is ON and an air system blower or system fan is OFF. The first operating condition could be referred to as or called a "still air condition". In this operating condition I and with the UV lamp venting fan ON, as shown in FIG. 3, the UV lamp intensity output 310 is steady at about 110 mW/cm$^2$ about 10.5 minutes after the UV lamp 205 is turned ON. During the same time period, the temperature outside the UV lamp 320, i.e., external to the vented quartz sleeve or tube 220, is substantially constant at about 78° F., while the temperature inside the UV lamp 330, i.e., the air space between the UV lamp 205 and the tube or sleeve 220 interior, increases from about 78° F. to 150° F.

In contrast, when the UV lamp fan 240 is OFF in the first operating condition I, as shown in FIG. 4, the UV lamp intensity output 410 initially increases to about 110 mW/cm$^2$ at 3 minutes after the UV lamp 205 is turned ON and then drops to about 50 mW/cm$^2$ at 15 minutes before stabilizing at about 60 mW/cm$^2$. During the same time period, the temperature outside the UV lamp 420 increases to a constant 85° F., while the temperature inside the UV lamp 430 increases from about 75° to 145° F. The first operating condition I, shown in FIGS. 3 and 4, illustrates that the air flow provided by the UV lamp fan 240 increases the UV intensity output 310 of the UV lamp to about a constant 110 mW/cm$^2$ resulting in improved germicidal and bactericidal effect.

In a second operating condition II, the UV lamp 205 with the closed end vented quartz sleeve or tube 220 is ON and an air system blower or system fan is also ON. In this operating condition II and with the UV lamp venting fan 240 ON, as shown in FIG. 3, the UV lamp intensity output 310 is maintained steady at about 110 mW/cm$^2$. During the same time period, the temperature inside the UV lamp 330 decreases from about 150° F. to a steady 95° F., while the temperature outside the UV lamp 320 stays substantially constant at about 80° F. The decrease in the temperature inside the UV lamp 330 is mainly due to the air flow introduced in the air system by the system blower or fan. The novel UV lamp assembly 200 maintains the UV lamp intensity output 310 steady at about 110 mW/cm$^2$ thereby maintaining its increased germicidal and bactericidal effect at substantially normalized or constant internal UV lamp temperature 330.

In contrast, when the UV lamp fan 240 is OFF in the second operating condition II, as shown in FIG. 4, the UV lamp intensity output 410 steadily ramp up from about 70 mW/cm$^2$ to about 90 mW/cm$^2$. During the same time period, the temperature inside the UV lamp 430 decreases from about 145° F. to about 95° F., while the temperature outside the UV lamp 420 decreases to about 85° F. The second operating condition II, shown in FIGS. 3 and 4, again illustrates that the UV lamp assembly 200 of the present invention with air flow provided by the UV lamp fan 240 has improved UV intensity output 310 of about 110 mW/cm$^2$ at a normalized temperature of about 95° F. resulting in improved germicidal and bactericidal effect.

In a third operating condition III, the UV lamp 205 with the closed end vented quartz sleeve or tube 220 is ON, the air system blower or system fan is also ON and the AC unit is ON. In this operating condition III and with the UV lamp venting fan 2400N, as shown in FIG. 3, the UV lamp intensity output 310 is substantially steady at about 110 mW/cm$^2$. During the same time period, the temperature inside the UV lamp 330 decreases from about 95° F. to a steady 75° F., while the temperature outside the UV lamp 320 decreases to about 55° F. The decrease in the temperature inside the UV lamp 330 can be attributed to the AC unit being turned ON which introduces cool air that is forced through the air duct system by the system blower or fan. The novel UV lamp assembly 200 maintains the UV lamp intensity output 310 steady at about 110 mW/cm$^2$ providing increased germicidal and bactericidal effect at substantially constant internal UV lamp temperature 330.

In contrast, when the UV lamp fan 240 is OFF in the third operating condition III, as shown in FIG. 4, the UV lamp intensity output 410 continues to increase from about 90 mW/cm$^2$ to about 100 mW/cm$^2$. During the same time period, the temperature inside the UV lamp 430 decreases from about 95° F. to about 75° F., while the temperature outside the UV lamp 420 decreases to about 55° F. The third operating condition III, shown in FIGS. 3 and 4, again illustrates that the UV lamp assembly 200 of the present invention with air flow provided by the UV lamp fan 240 has improved UV intensity output 310 of about 110 mW/cm$^2$ at a normalized temperature of about 75° F. resulting in improved germicidal and bactericidal effect.

In a fourth operating condition IV, the UV lamp 205 with the closed end vented quartz sleeve or tube 220 is ON, the air system blower or system fan is also ON and the AC unit is now OFF. In this operating condition IV and with the UV lamp venting fan 240 ON, as shown in FIG. 3, the UV lamp intensity output 310 decreases slightly when the AC unit is turned OFF but then returns to a substantially steady intensity output of about 110 mW/cm$^2$. During the same time period, the temperature inside the UV lamp 330 increases from about 75° F. back to about 95° F., while the temperature outside the UV lamp 320 increases to about 75° F. The increase in the temperature inside the UV lamp 330 can be attributed to the AC unit being turned OFF which takes away the cool air being forced through the air duct system by the system blower or fan. The novel UV lamp assembly 200 maintains the UV lamp intensity output 310 steady at about 110 mW/cm$^2$ providing increased germicidal and bactericidal effect.

In contrast, when the UV lamp fan 240 is OFF in the fourth operating condition IV, as shown in FIG. 4, the UV lamp intensity output 410 decreases continually from about 100 mW/cm$^2$ to about 90 mW/cm$^2$. During the same time period, the temperature inside the UV lamp 430 increases from about 75° F. to about 95° F., while the temperature outside the UV lamp 420 increases to about 75° F. The fourth operating condition IV, shown in FIGS. 3 and 4, again illustrates that the UV lamp assembly 200 of the present invention with air flow provided by the UV lamp fan 240 has improved UV intensity output 310 of about 110 mW/cm$^2$ resulting in improved germicidal and bactericidal effect.

In a fifth operating condition V, the UV lamp 205 with the closed end vented quartz sleeve or tube 220 is ON, the air system blower or system fan is now OFF and the AC unit is also OFF. In this operating condition V and with the UV lamp venting fan 240 ON, as shown in FIG. 3, the UV lamp intensity output 310 remains substantially at about 110 mW/cm$^2$. During the same time period, the temperature inside the UV lamp 330 increases from about 95° F. up to about 140° F., while the temperature outside the UV lamp 320 increases to about 90° F. The increase in the temperature inside the UV lamp 330 can be attributed to the system blower or fan being turned OFF which takes away the air flow in the air duct system by the system blower or fan. The novel UV lamp assembly 200 maintains the UV lamp intensity output 310 steady at about 110 mW/cm$^2$ providing increased germicidal and bactericidal effect.

In contrast, when the UV lamp fan 240 is OFF in the fifth operating condition V, as shown in FIG. 4, the UV lamp intensity output 410 continues to decreases from about 95 $mW/cm^2$ to about 85 $mW/cm^2$. During the same time period, the temperature inside the UV lamp 430 increases from about 95° F. to about 140° F., while the temperature outside the UV lamp 420 increases to about 90° F. The increase in the temperature inside the UV lamp 430 can be attributed to the UV lamp fan 240 and the system blower fan being turned OFF which results in loss of circulation or air flow into and out of the vented quartz sleeve 220 and loss of the air flow in the air duct system provided by the system blower or fan. The increased internal UV lamp temperature 430 in turn decreases the UV lamp intensity output. The fifth operating condition V, shown in FIGS. 3 and 4, again illustrates that the UV lamp assembly 200 of the present invention with air flow provided by the UV lamp fan 240 has improved UV intensity output 310 of about 110 $mW/cm^2$ resulting in improved germicidal and bactericidal effect.

The invention has been described and illustrated with respect to certain preferred embodiments by way of example only. Those skilled in that art will recognize that the preferred embodiments may be altered or amended without departing from the true spirit and scope of the invention. For example, the UV lamp assembly could be used in or with devices used to sterilize medical instruments, equipment, apparatus and facilities. Therefore, the invention is not limited to the specific details, representative devices, and illustrated examples in this description. The present invention is limited only by the following claims and equivalents.

What is claimed is:

1. An ultraviolet lamp assembly for emission of radiation in a wavelength range having a purification, germicidal or bactericidal effect comprising:

an ultraviolet lamp;

a tube operative to house said ultraviolet lamp, said tube comprising, a closed end, and an open end adapted to permit insertion of said ultraviolet lamp, said open end having a plurality of vents that allow air into and out of an air space between said ultraviolet lamp and said tube; and a tube divider operatively disposed between said ultraviolet lamp and said tube to thereby divide said air space into at least two air space compartments enabling airflow into and out of said tube.

2. The ultraviolet lamp assembly of claim 1, wherein said ultraviolet lamp is an ozone generating or ozone free ultraviolet lamp.

3. The ultraviolet lamp assembly of claim 1, wherein said tube is a quartz tube.

4. The ultraviolet lamp assembly of claim 1, wherein said tube is comprised of material that is transparent to ultraviolet radiation.

5. The ultraviolet lamp assembly of claim 1, wherein said air displacer is a fan able to provide air flow in said range of 0.5 cfm to 10 cfm.

6. The ultraviolet lamp assembly of claim 2, wherein said ultraviolet lamp emits radiation at a wavelength of 254 nm.

7. The ultraviolet lamp assembly of claim 1, wherein said air displacer is a fan able to provide air flow to maintain a temperature outside said ultraviolet lamp in a range of between 85° F. to 95° F.

8. The ultraviolet lamp assembly of claim 7, wherein said air flow is able to maintain air around said ultraviolet lamp at about 90° F.

9. The ultraviolet lamp assembly of claim 1, further comprising an air displacer operatively connected to at least one of said vents and able to produce air flow in said tube.

10. An ultraviolet lamp assembly for emission of radiation having a germicidal or bactericidal affect comprising;

an ultraviolet lamp;

a tube operative to house said ultraviolet lamp;

said tube comprising, a closed end, and an open end able to allow insertion of said ultraviolet lamp, the open end having a plurality of vents that allow air into and out of an air space between the ultraviolet lamp and said tube;

a tube divider operatively disposed between said ultraviolet lamp and said tube to thereby divide said air space into at least two air space compartments enabling air to circulate through said tube; and an air displacer operatively connected to at least one of said vents and able to produce air flow in said tube.

11. The ultraviolet lamp assembly of claim 10, wherein said ultraviolet lamp is an ozone generating or ozone free ultraviolet lamp.

12. The ultraviolet lamp assembly of claim 11, wherein said ultraviolet lamp emits radiation at a wavelength of 254 nm.

13. The ultraviolet lamp assembly of claim 10, wherein said tube is a quartz tube.

14. The ultraviolet lamp assembly of claim 10, wherein said tube is comprised of material that is transparent to ultraviolet radiation.

15. The ultraviolet lamp assembly of claim 10, wherein said air displacer is a fan able to provide air flow in said range of 0.5 cfm to 10 cfm.

16. The ultraviolet lamp assembly of claim 10, wherein said air displacer is a fan able to provide air flow to maintain, a temperature outside said ultraviolet lamp in a range of between 85° F. to 90° F.

17. The ultraviolet lamp assembly of claim 16, wherein said air flow is able to maintain air around said ultraviolet lamp at about 90° F.

18. A method of maintaining a desired ultraviolet lamp temperature in an ultraviolet lamp assembly comprising the steps of:

disposing an ultraviolet lamp in a tube, said tube comprising a closed end and an open end able to allow insertion of said ultraviolet lamp, said open end having a plurality of vents that allow air into and out of an air space between said ultraviolet lamp and said tube;

disposing a tube divider between said ultraviolet lamp and said tube to thereby divide said air space into at least two air space compartments to enable airflow into and out of said tube;

operatively connecting an air displacer to at least one of said vents;

operating said air displacer to produce air flow into and out of said air space compartments to thereby maintain said air space around said ultraviolet lamp at said desired temperature for improved germicidal affect of said ultraviolet lamp.

19. The method of claim 18, wherein said ultraviolet lamp is an ozone generating or ozone free ultraviolet lamp.

20. The method of claim 18, wherein said tube is a quartz sleeve.

21. The method of claim 18, wherein said ultraviolet lamp emits radiation at a wavelength of 254 nm.

22. The method of claim 18, wherein said air flow is able to maintain air around said ultraviolet lamp at about 90° F.

* * * * *